US007832316B2

(12) United States Patent
Weber

(10) Patent No.: US 7,832,316 B2
(45) Date of Patent: Nov. 16, 2010

(54) APPARATUS FOR THE SLICING OF FOOD PRODUCTS HAVING TWO CUTTER HEADS

(75) Inventor: Gunther Weber, Zachow (DE)

(73) Assignee: Weber Maschinenbau GmbH & Co. KG, Breidenbach (DE)

( * ) Notice: Subject to any disclaimer, the term of this patent is extended or adjusted under 35 U.S.C. 154(b) by 62 days.

(21) Appl. No.: 11/001,157

(22) Filed: Dec. 1, 2004

(65) Prior Publication Data

US 2005/0132855 A1 Jun. 23, 2005

Related U.S. Application Data

(63) Continuation-in-part of application No. 10/415,627, filed as application No. PCT/EP01/12724 on Nov. 2, 2001, now abandoned.

(30) Foreign Application Priority Data

Nov. 3, 2000 (DE) ..... 100 54 514

(51) Int. Cl.
*B26D 1/29* (2006.01)

(52) U.S. Cl. ..... 83/155; 83/932; 198/357

(58) Field of Classification Search ..... 83/932, 83/155, 272, 155.1, 595, 672; 198/357, 358, 198/444, 448, 339.1, 836.1
See application file for complete search history.

(56) References Cited

U.S. PATENT DOCUMENTS

| | | | | |
|---|---|---|---|---|
| 2,577,086 | A * | 12/1951 | Magnuson | 83/436.45 |
| 3,708,055 | A | 1/1973 | Miller et al. | 198/34 |
| 5,054,345 | A | 10/1991 | Weber | 83/42 |
| 5,482,166 | A | 1/1996 | Brown | 9/580 |
| 5,724,874 | A | 3/1998 | Lindee et al. | 83/27 |
| 6,370,447 | B1 * | 4/2002 | Miyazaki | 700/230 |
| 7,168,552 | B2 * | 1/2007 | Katayama | 198/460.1 |
| 2002/0112938 | A1 * | 8/2002 | Shiohara | 198/357 |

FOREIGN PATENT DOCUMENTS

| | | |
|---|---|---|
| DE | 1698324 | 4/1955 |
| DE | 2351980 | 4/1975 |
| DE | 3612996 | 10/1987 |
| DE | 29513043 U1 | 10/1995 |
| DE | 19713163 | 9/1998 |
| EP | 0336798 | 10/1989 |
| EP | 0867263 | 9/1998 |
| FR | 2686776 | 8/1993 |
| JP | 59-193695 | 12/1984 |
| JP | 60-177896 | 9/1985 |
| JP | 03-098792 | 4/1991 |
| JP | 10-118982 | 5/1998 |
| WO | 85/04833 | 11/1985 |
| WO | 00/59689 | 10/2000 |

* cited by examiner

*Primary Examiner*—Ghassem Alie
(74) *Attorney, Agent, or Firm*—Gifford, Krass, Sprinkle, Anderson & Citkowski, P.C.

(57) ABSTRACT

An apparatus for slicing food products. The apparatus includes at least two cutter heads integrated with a common base construction and in which a food supply is provided for each cutting knife. The product flows from the cutter heads are combined into a single outflow conveyor.

11 Claims, 4 Drawing Sheets

APPARATUS FOR THE SLICING OF FOOD PRODUCTS HAVING TWO CUTTER HEADS

RELATED APPLICATIONS

This application is a continuation-in-part of U.S. patent application Ser. No. 10/415,627 filed Jul. 24, 2003 now abandoned, which is a 371 of PCT/EP01/12724 filed Nov. 2, 2001, which claims priority of German Patent Application 100 54 514.9 filed Nov. 3, 2000.

BACKGROUND OF THE INVENTION

I. Field of the Invention

The invention relates to an apparatus for the slicing of food products, in particular ham, sausage, cheese and the like, having a product supply system and a cutting station as well as conveying means disposed downstream of the cutting station for the transporting away of the sliced products.

II. Description of the Prior Art

Apparatuses of this kind, which are also termed slicers, are known. Slicers are also already in practical use which have two product supply units which extend parallel to one another for the purpose of increasing the cutting performance such that two products can be sliced simultaneously with the cutting knife circulating in a planetary manner and driven in a rotating manner.

All currently known slicers have only one single cutter head and have intermittent or continuous supply feeds. Intermittent supply feeds are as a rule used for short products such as raw ham or a block of cheese, whereas the continuous supply feeds are used for long product strings such as sausage or boiled ham.

Intermittent supply feeds above all have the disadvantage of time loss and the interruption of the product flow caused by this resulting from the respective very high loading time in relation to the cutting time.

Continuous supply feeds have the disadvantage that the products are no longer sufficiently guided or held toward the end of the cutting process and losses thereby occur due to the transition region between the products. Moreover, it generally applies to slicers having only one cutter head that the maximum product width to be cut is restricted in dependence on the respectively used single cutter head.

Furthermore, it is disadvantageous in the known apparatuses of this kind that it is not possible, or is only possible with a very high technical conveying effort, to achieve a continuous product flow in connection with the successive slicing of the individual products such as is required for packaging machines operating without interruption.

SUMMARY OF THE PRESENT INVENTION

It is the object of the invention to decisively increase the capacity in an apparatus of the kind first named with at least approximately the same personnel effort and to make possible an optimum utilization of succeeding systems.

This is above all achieved by the invention in that the apparatus is equipped with at least two cutter heads and the product flows produced per cutter head are either guided together to form a preferably continuous product flow and are further processed or are further processed in the form of a plurality of product flows.

The advantages of the apparatus in accordance with the invention, in which the product supply unit, or the product supply units, as well as the cutter heads respectively associated with them and having associated drives are integrated in a common base construction, can be represented as follows with respect to their operation.

The following advantageous aspects result with a simultaneous output of at least two product flows, in particular in the use for long products which are supplied e.g. continuously, or in which the product change-over time plays a more subordinate role in relation to the cutting time due to the large product length.

Due to the use of at least two cutter heads per apparatus, at least a doubling of the maximum cutting width, and thus a doubling of the cutting performance, is created. This results in particular in the fact that, on the cutting of portions with a low number of slices, the capacity of the existing downstream systems, e.g. the packaging machines, can be utilized to the full, which was previously frequently not achievable.

The following applies to the case of an operation of the apparatus in which the product flows are output alternately, i.e. not parallel, in particular in the use for short products in which, due to the low product length, the product change-over time represents a substantial disadvantage in relation to the cutting time for the continuity of the succeeding processes, and thus of the total performance of the system.

Due to this alternate operation, or to the alternate output of the product flows, the irritating product change-over time does not come into effect, since, during the cutting time of the one cutter head, the supply feed of another cutter head can be loaded.

This in turn has the consequence that intermediate storage procedures in the conveying systems disposed downstream can be omitted, on the one hand, and the unwanted stopping of packaging machines, which was previously only possible with a large technical conveying effort, is no longer required, on the other hand.

During the good cutting phase of a product located in a product supply unit, not only a feed procedure can be carried out in another product supply feed, but also an initial cutting procedure with a simultaneous guiding away of chips and not yet usable slices. This has the consequence that, at a suitable point in time at which the end region of the product to be sliced, which is no longer usable with respect to the required slices is reached in the one supply unit, the product feed can be stopped, and in the other product supply unit the product feed can be started such that now this unit newly taken into operation delivers slices of the same kind.

By a technical conveying guiding together of the slice flows originating from the two units, the required uninterrupted flow of good slices, i.e. a flow of slices with the required thickness and size, is obtained.

It is particularly interesting that this operation can also be realized when products of small length, e.g. products which are shorter than approximately 80 cm, have to be sliced.

An individual operation of the individual supply units as well as of the cutter heads associated with them and having different knife revolution speeds makes it possible to slice different products with different numbers of slices simultaneously per time unit and thus in turn to produce so-called mixed packs in a particularly economic manner in connection with the corresponding conveying technique.

Within the framework of the invention, it is of substantial importance that the overall performance of the apparatus can be considerably increased with approximately the same personnel effort and the capacity of existing succeeding systems can be utilized better.

Further advantageous embodiments of the invention are recited in the dependent claims.

BRIEF DESCRIPTION OF THE DRAWING

An embodiment of the invention will be explained in the following by way of example with reference to the drawing, in which are shown.

DETAILED DESCRIPTION OF A PREFERRED EMBODIMENT OF THE PRESENT INVENTION

Figure 1:
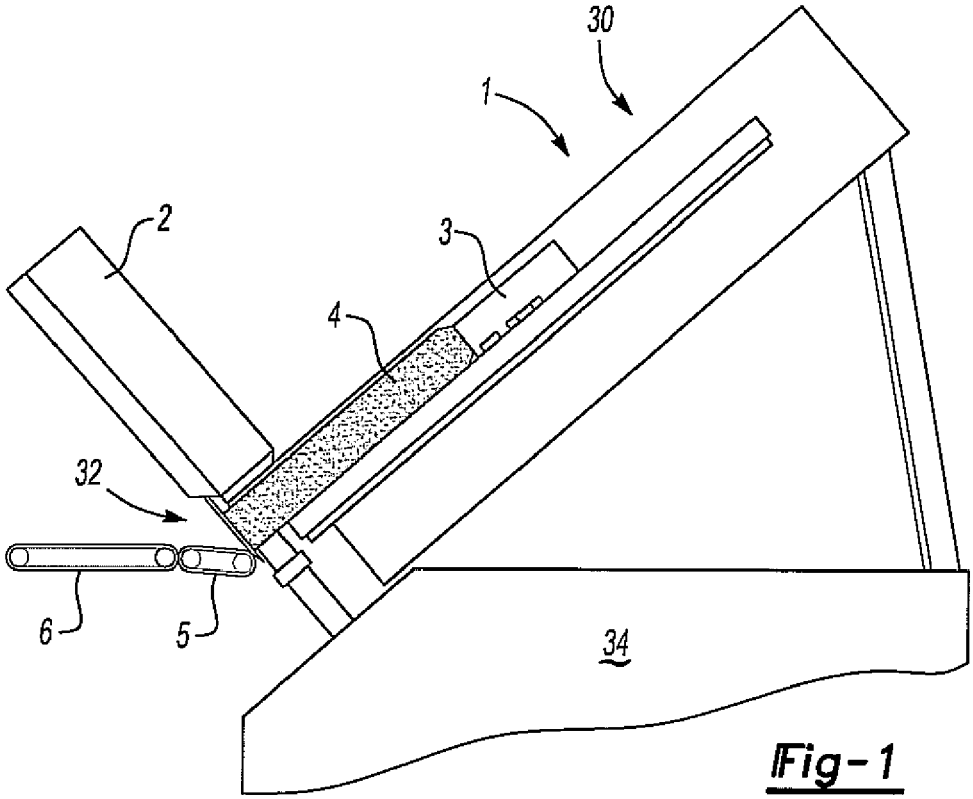
FIG. 1 is a schematic side view of a slicer in accordance with the invention.
Figure 2:
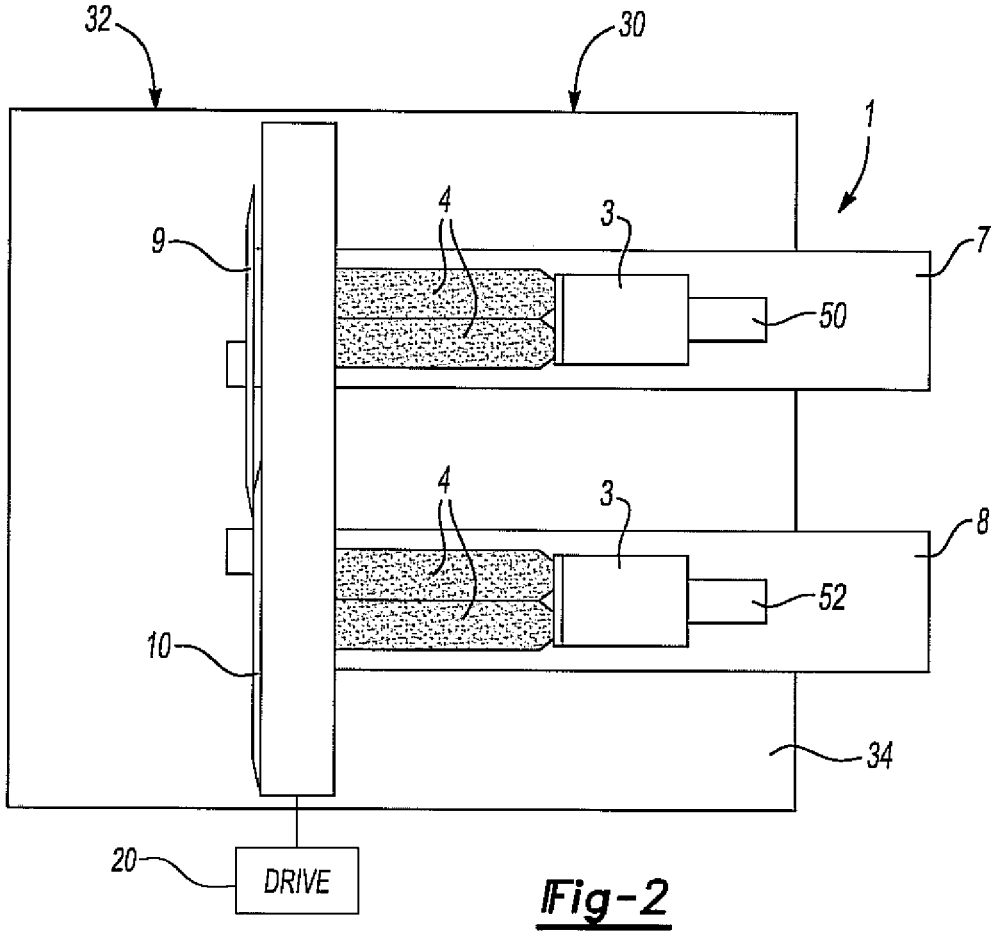
FIG. 2 is a plan view of the slicer in accordance with FIG. 1.

FIGS. 1 and 2 show a preferred embodiment of the invention with a product supply system 30 and a cutting station 32 in a common base construction 34.

FIG. 1 shows the basic components of a slicer formed in accordance with the invention in a side view, with the product supply feed 1, which extends obliquely to the horizontal, and the cutter head housing 2, which is provided at the end of the product supply feed 1, being able to be seen. The product supply feed 1 includes one or more product holders 3 for products 4 to be sliced. A first conveyor 5, which is formed in a relatively short manner, is provided to receive the slices formed during the cutting process and has a belt 6 for transporting away disposed downstream of it. Further conveyor elements and conveyor units which are used for the separate guiding away of individual slice flows or for the guiding together of a plurality of slicer flows are not shown in the embodiment of FIGS. 1 and 2.

The conveyor unit 5 intended for the direct reception of the cut slices can be operated in the forward direction and in the reverse direction so that chips arising in particular in starting cut procedures or non-usable slices can be guided away in reverse operation.

An individually controllable conveyor 5 is preferably provided for each cutter head and can also be made lowerable for the forming of stacks.

Like all apparatuses formed in accordance with the invention, the embodiment shown in the drawings is equipped with at least two cutter heads, which can be seen individually in FIG. 2. Each cutter head includes a knife 9 or 10 respectively, with this knife being able to be designed as a sickle knife or as a round knife circulating in a planetary manner. Each knife 9 and 10 may have its own associated drive 22 and 24, respectively, as illustrated diagrammatically in FIG. 3, so that the rotary speed of the knives may be individually controlled. Optionally, a common drive 20 illustrated diagrammatically in FIG. 2, rotatably drives both knives 9 and 10.

At least the cutting knives are preferably arranged in an axially offset manner and they can be driven by a common drive or independently of one another. The supply feed of the products 4 to be sliced to the respective cutter heads can take place by means of a product supply feed 1 common to the cutter heads, i.e. the product holders 3 are driven by a common motor and are actuated together with respect to the forward feed movements and backward stroke movements.

In this case, at least two product flows are output at the same time and this variant is in particular suitable for long products in which the product change-over time is very small with respect to the cutting time.

Above all on the slicing of short products, in which the product change-over time is relatively large with respect to the cutting time due to the low product length, each cutting unit has its own product supply unit 7, 8 associated with it. In this case, the product supply units can be controlled individually by control units 50 and 52, respectively (FIG. 2) and the product flows are output alternately. Alternatively, the control units 50 and 52 may be combined into a single unit and the supply units operated synchronously with each other. Since, during the cutting time of one cutter head, the supply feed of another cutter head is loaded, it is possible in this manner to avoid any irritatingly long product change-over time. It is rather possible to add the product flows arising in alternate operation to one another without interruption.

Figure 3:
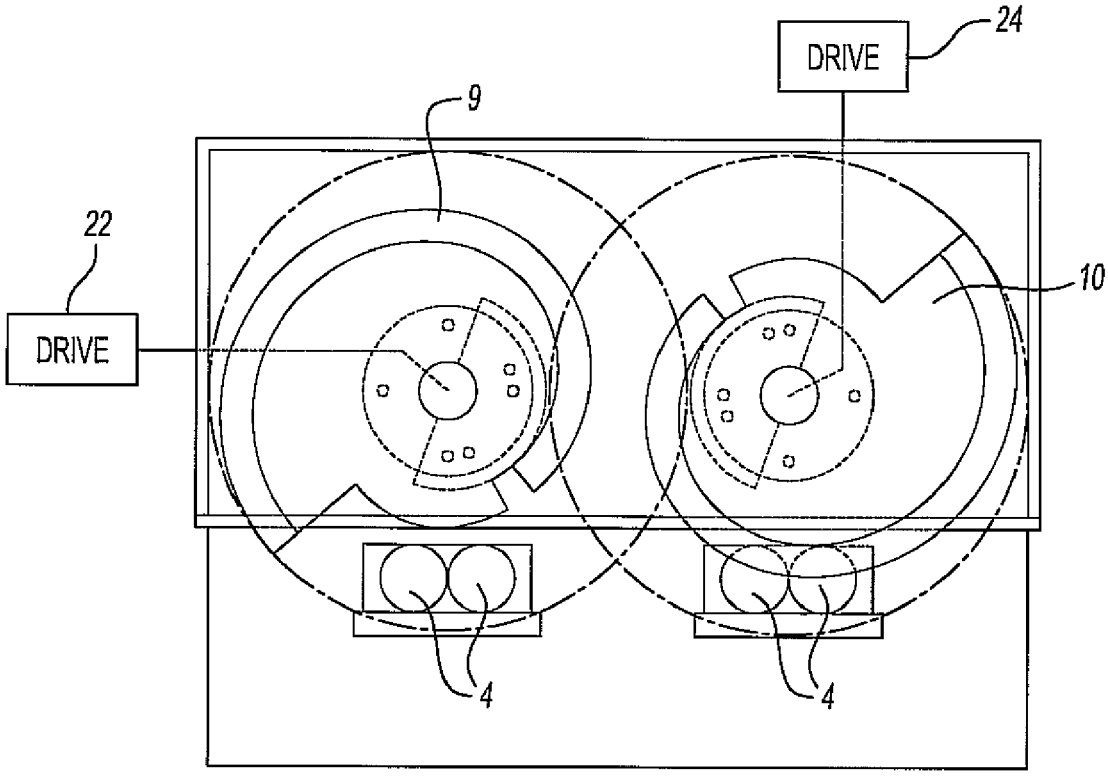
FIG. 3 is a front view of the dual cutter head of the slicer in accordance with FIGS. 1 and 2.
Figure 4:
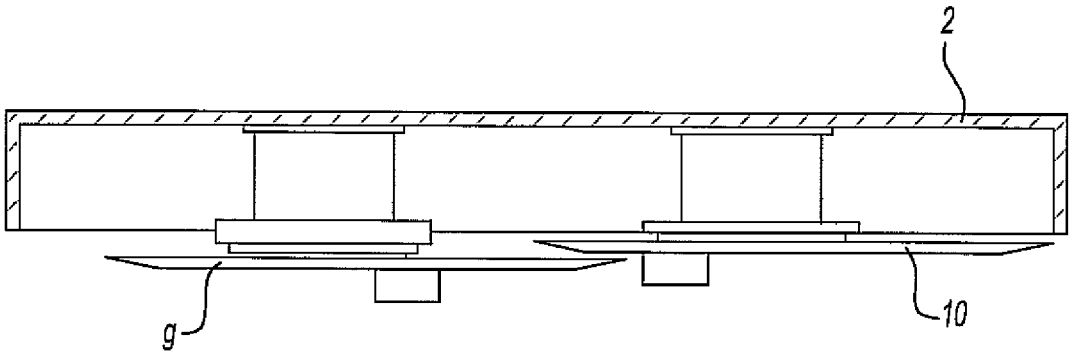
FIG. 4 is a schematic plan view of the dual cutter head in accordance with FIG. 3.

The front view in accordance with FIG. 3 shows two cutter heads arranged next to one another in the same apparatus and having sickle knives 9, 10. The products 4 supplied to the respective cutting knives lie within the respective circumferential cutting circles and it can also be seen that the cutting knives of the two cutter heads run at offset angles to one another in their orbits. Furthermore, the cutting knives 9, 10 as can in particular be seen in FIG. 4—are arranged offset to one another in the axial direction.

Even though only two cutter heads are shown in connection with the embodiment, it is understood that a larger number of cutter heads can also be used within the framework of the invention and these—just like the two cutter heads in accordance with the embodiment shown—are integrated into a common base construction including the product supply unit, or the product supply units, associated with them and all associated drives.

Figure 5:
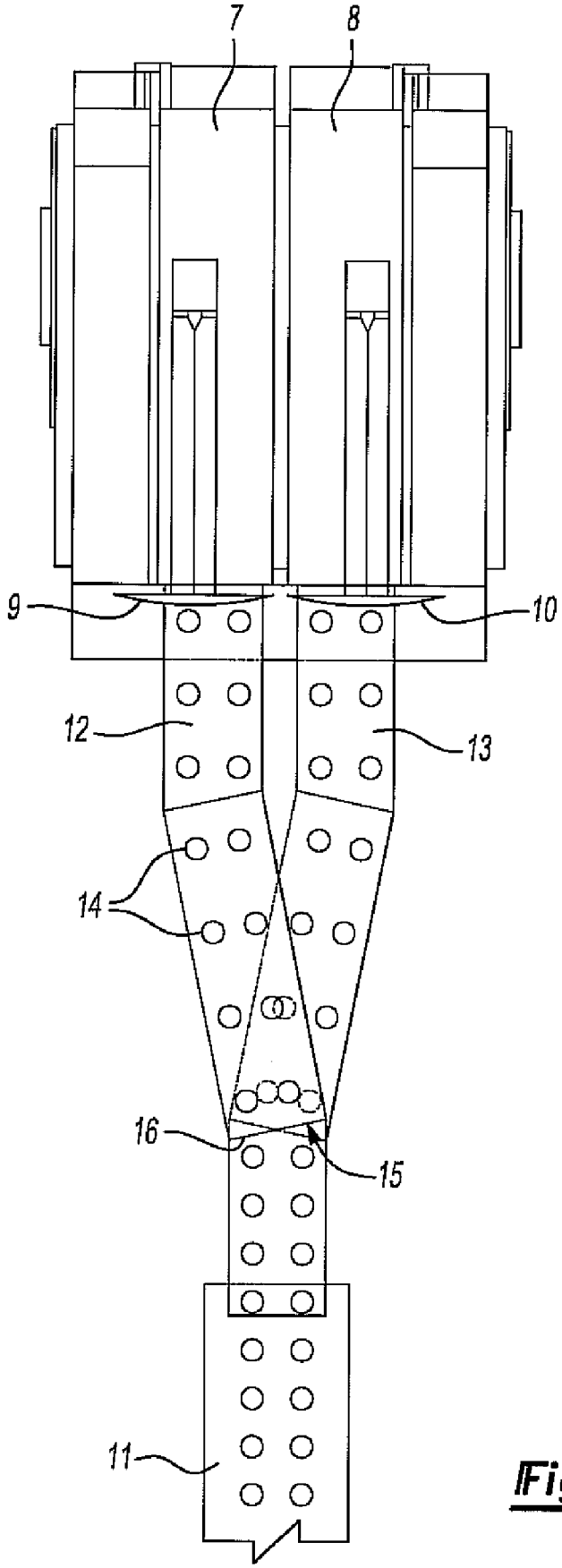
FIG. 5 is a top plan view illustrating a first preferred embodiment of the present invention.

With reference now to FIG. 5, a preferred embodiment of the present invention is shown in which each slicing knife 9 and 10 has its own product supply 7 and 8 as well as a common conveyor 11 for transporting the resulting product downstream for further processing, for example packaging in a packaging unit (not shown). A first conveyor 12 receives the sliced product from the cutting knife 9 while, similarly, a second conveyor 13 receives the sliced product from the cutting knife 10. Both conveyors 12 and 13 transport product 14 on the conveyors 12 and 13 toward the common conveyor 11.

The two conveyors 12 and 13 meet at a shunt 15 intermediate the cutting knives 9 and 10 and the common conveyor 11. More specifically, the conveyor 12 is positioned above and thus overlaps the conveyor 13 at a free end 16 of the first conveyor 12. Consequently, product 14 that is conveyed by the conveyor 12 passes over the free end 16 of the conveyor 12 and drops down onto the conveyor 13. Thereafter, the combined product from the conveyors 12 and 13 is transported by the conveyor 13 to the common conveyor 11.

If desired, the conveyors 12 and 13, as well as the knives 9 and 10, are accurately timed so that the product exiting from the first conveyor 12 onto the second conveyor 13 will fall into the gaps between the product on the conveyor 13.

A primary advantage of the invention as shown in FIG. 5 is that a continuous product stream is provided on the conveyor 11 even if the supply of one of the cutting units 7 or 8 is discontinuous. For example, assuming that there is a product supply in the product supply unit 7 and that the product 8 is currently being loaded, a continuous flow of product is provided from the product supply unit 7 to the common conveyor 11 by the conveyor 12 and the end portion of the conveyor 13. After the product supply unit 8 has been loaded with product, the cutting knife 10 associated with the product supply unit 8 is activated when the product supply unit 7 becomes empty. In this event, the second conveyor 13 will provide product to the common conveyor 11 while the first product supply unit 7 is loaded with product.

Consequently, activation of the cutting knives 9 and 10 may be timed in two different fashions. In the first fashion, as described above, both conveyors 12 and 13 provide product to the common conveyor 11 and so that the product 14 from the first conveyor 12 is positioned within the space between successive units of product 14 on the second conveyor 13. Alternatively, the timing of the cutting knives 9 and 10 are timed, together with their associated conveyors 12 and 13, to provide a continuous product supply to the conveyor 11 despite alternate reloading of the product units 7 and 8 with product as necessary. In either event, a continuous product stream is provided to the common conveyor 11.

Figure 6:
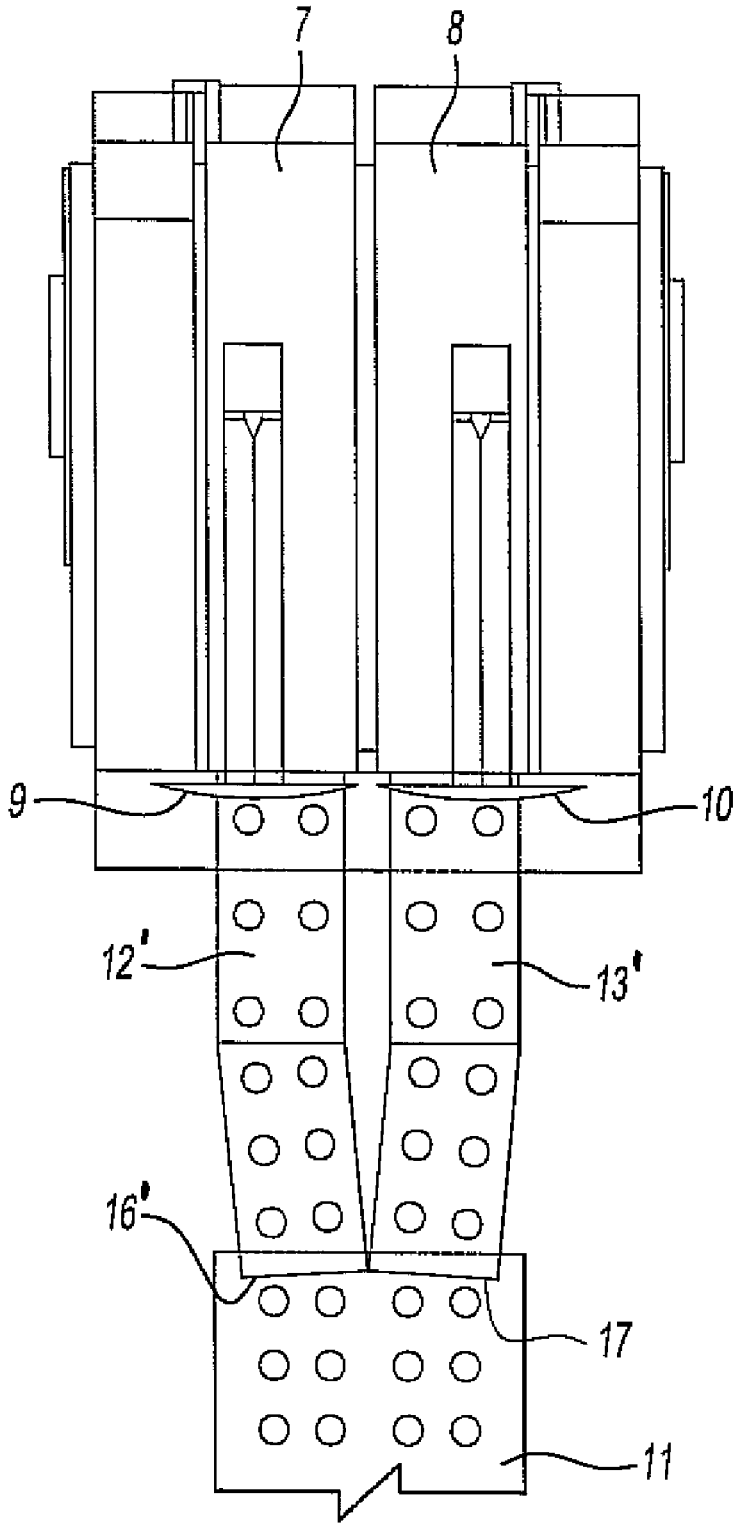
FIG. 6 is a top plan view, similar to FIG. 5, but illustrating a further embodiment of the present invention.

With reference now to FIG. 6, a further preferred embodiment of the present invention is shown which is similar to that of FIG. 5 except that the conveyor 12' does not overlap the conveyor 13' at its free end 16'. Instead, the free ends 16' and 17 of the conveyors 12' and 13', respectively, are positioned adjacent each other at a receiving end of the common conveyor 11. In this fashion, as long as product is provided in at least one of the product supply units 7 or 8, a continuous product stream is provided to the conveyor 11 even though one of the product supply units 7 or 8 is being reloaded with fresh product. It will, of course, be understood that while the products loaded into the product supply units 7 and 8 may be the same type of product, they may alternatively be of different products. In the event that different products are loaded into the product supply units 7 and 8, a multi-composition product will result.

Having thus described my invention, it will become apparent to those skilled in the art that the present invention provides an apparatus for slicing food products which ensures that a continuous product stream will be provided to the common conveyor 11 for further processing, such as packaging or the like. Having described my invention, however, many modifications thereto will become apparent to those skilled in the art to which it pertains without deviation from the spirit of the invention as defined by the scope of the appended claims.

I claim:

1. An apparatus for the slicing of food products having a product supply system and a cutting station as well as an outflow conveyor disposed downstream of the cutting station for the transporting away of the sliced products, characterized in that the apparatus is equipped at the cutting station with at least two cutter heads, each having a knife, which cutter heads are mounted to a common base construction;

wherein the product supply system includes a first and a second product supply unit for at least two products, said product supply units being arranged adjacent to each other and aligned with an associated one of the cutter heads;

wherein each cutter head produces a separate product flow, a first conveyor which receives the product flow from one cutter head and a second conveyor receiving the product flow from the other cutter head, said first and second conveyors being independently movable relative to each other, which product flows are conveyed by said first and second conveyors to a common merging location wherein the common merging location is a location where the first conveyor coming from one cutter head and the second conveyor coming from the other cutter head meet in order to form a merged product flow to be conveyed on the outflow conveyor; and a cutter head housing disposed around both of said cutter heads.

2. An apparatus in accordance with claim 1, characterized in that the product supply units are controlled individually with respect to their feed movements and their retraction movements.

3. An apparatus in accordance with claim 1, characterized in that the first and second product supply units are arranged obliquely to the horizontal.

4. An apparatus in accordance with claim 1, characterized in that the cutter heads associated with the first and second product supply units are driven by a common drive.

5. An apparatus in accordance with claim 1, characterized in that the cutter heads associated with the first and second product supply units each have their own drive.

6. An apparatus in accordance with claim 5, characterized in that the speeds of revolution of the drives, and thus the cuts carried out by the respective knife per unit of time, are set differently and thus portions of different numbers of slices can be produced.

7. An apparatus in accordance with claim 1, characterized in that the cutting plane of the individual cutter heads defined, by the plane of circulation of the knives and thus the respectively associated cutting edges, are offset to one another in the axial direction.

8. An apparatus in accordance with claim 1, characterized in that the knives run angularly offset to one another in their orbits.

9. An apparatus in accordance with claim 1, characterized in that the first and second product supply units as well as the cutter heads respectively associated with them are integrated in the common base construction.

10. The invention as defined in claim 1, wherein an end of said first conveyor at said common merging location is positioned above said second conveyor so that sliced product from said first conveyor falls from said end of said first conveyor onto said second conveyor.

11. The invention as defined in claim 10 and comprising means for controlling said cutter heads so that product slices from said first conveyor are positioned between successive slices on said second conveyor.

* * * * *